United States Patent [19]

Scheidegger

[11] 4,445,310

[45] May 1, 1984

[54] PROCESS AND INSTALLATION FOR SUPPLYING CAPS TO A CLOSURE MACHINE

[75] Inventor: Albert Scheidegger, Villeurbanne, France

[73] Assignee: Scal Societe de Conditionnements en Aluminium, Paris, France

[21] Appl. No.: 318,961

[22] Filed: Nov. 6, 1981

[30] Foreign Application Priority Data

Nov. 14, 1980 [FR] France ..... 80 24691

[51] Int. Cl.[3] ..... B65B 57/00; B65B 57/02; B67B 3/26

[52] U.S. Cl. ..... 53/485; 53/64; 413/2; 413/50; 198/358

[58] Field of Search ..... 53/72, 75, 64, 287, 53/308; 413/45, 47, 48, 50, 2, 3; 198/358, 524

[56] References Cited

U.S. PATENT DOCUMENTS

| | | | |
|---|---|---|---|
| 2,952,104 | 9/1960 | Stover | 53/287 X |
| 3,546,847 | 12/1970 | Noguchi | 53/64 |
| 3,683,588 | 8/1972 | Ahlers | 53/64 |
| 4,373,624 | 2/1983 | Molins et al. | 198/358 X |

*Primary Examiner*—Horace M. Culver

*Attorney, Agent, or Firm*—Dennison, Meserole, Pollack & Scheiner

[57] ABSTRACT

A process and an installation for supplying fragile caps to a closure machine which operates at a high rate, wherein caps are manufactured in situ in a plurality of cells which operate in a parallel mode, with the caps then supplied to the closure machine by a single conveyor which preserves the orientation of the caps. Detectors disposed on inclined intermediate channels control the output rate of the cells and the conveyor to ensure the machine is supplied with caps at all times, even when a cell is stopped for maintenance.

12 Claims, 5 Drawing Figures

PROCESS AND INSTALLATION FOR SUPPLYING CAPS TO A CLOSURE MACHINE

Figure 1:
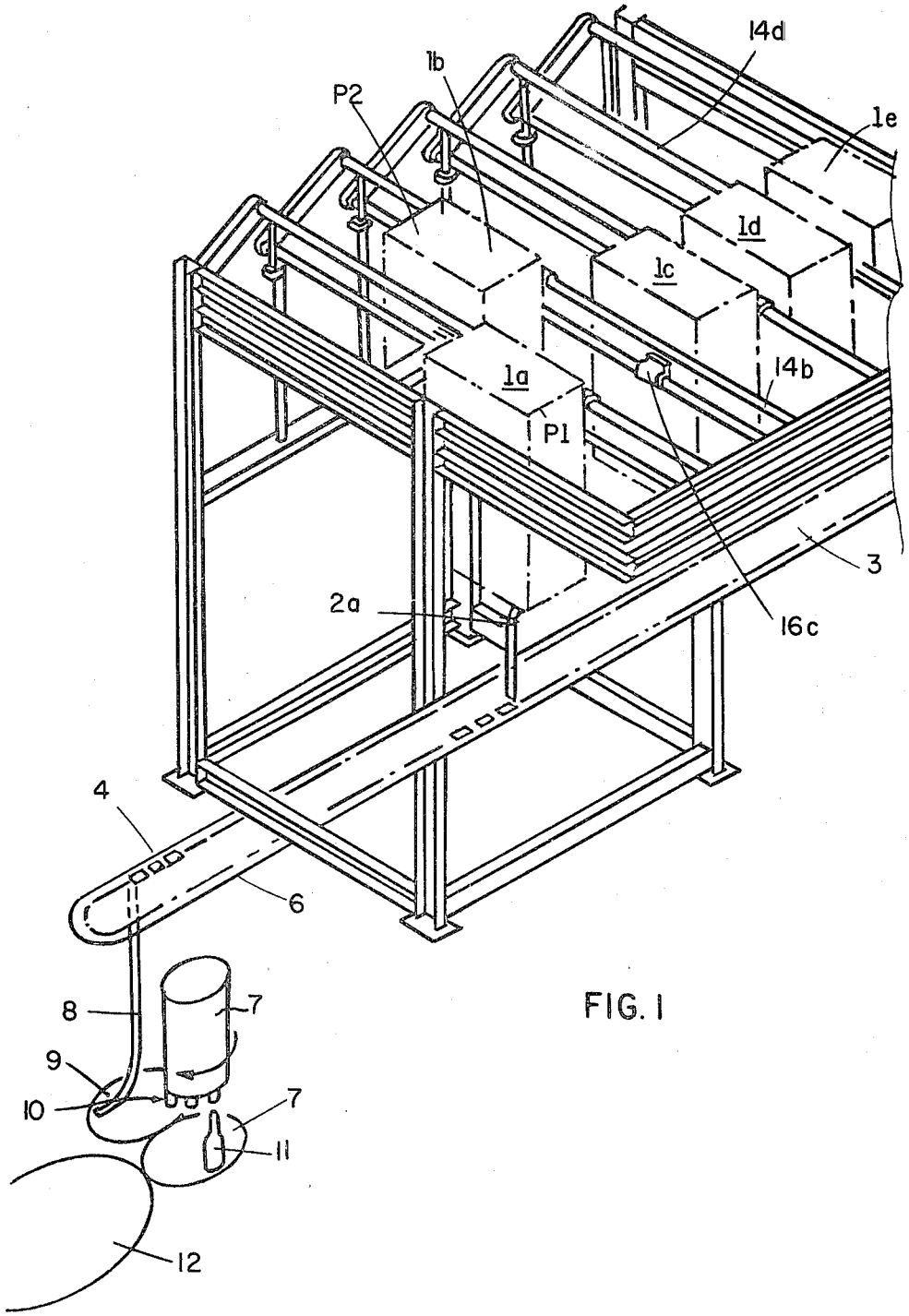

The invention relates to an installation for supplying fragile caps to a closure machine which operates at a high rate, by means of a plurality of production cells delivering closure members to a common conveyor.

Supplying a closure machine which operates at a high rate, that is to say, which has an output of the order of 60,000 closures per hour, gives rise to many problems.

Such machines are themselves integrated into packaging chains which include container supply and filling installations at an upstream position, and labelling and packing installations at a downstream position. A stoppage, even of short duration, in complex chains of this kind, represents a substantial loss of production. Such high-output chains move considerable flows of products, containers or caps, so that intermediate storage means corresponding to stoppages even of short duration represent substantial volumes and substantial levels of capital investment. The containers which in most cases are set in movement and displaced at high speed cannot be stopped instantaneously without the danger of the containers turning over, resulting both in a loss of product and also in a considerable distrubance all along the length of the packaging circuit. This is an even more serious situation if the containers are fragile, such as lightweight-glass bottles. For some gaseous drinks, an excessively abrupt stoppage causes the content of the container to overflow in the form of foam. With regard to beer, there is even the operation of 'closure on foam', in which the formation of foam is voluntarily initiated. The closure operation has to be carried out at the precise moment that the foam reaches the upper level of the neck of the container. Finally, setting ccmplex packaging chains in operation again is a long and delicate process. It is important that all the elements in the packaging chain, from the supply of product, containers or caps, down to the packaging station, operate in an absolutely reliable manner without jerks or interruptions.

If, for reasons of economy and ecology, there is a wish to use fragile caps, in particular caps of thin aluminium having projecting gripping tongue portions, like those described in French Pat. No. 2 375 136 or the patent of addition thereto, French Pat. No. 2 445 295, (U.S. Pat. No. 4,231,479) the problem involved in the supply of caps to the installation becomes a particularly difficult one. It is necessary to prohibit any transportation and storage in loose or bulk form in cartons or hoppers, and also any apparatus for orienting such caps. These caps easily suffer from deformation, and too frequently would cause jams and stoppages in the packaging chain.

In order to use fragile caps, particularly if they are asymmetric, it has been found that the only solution was for the caps to be produced in situ in a production unit which is incorporated in the bottling chain or in the immediate vicinity thereof, and for the caps to be passed directly to the closure machine, retaining their initial orientation as discharged from the production unit.

This solution moreover is economic from two points of view. While making it possible to use thin caps, it also reduces the cost of transportation and storage. It is sufficient for production units to be fed with strips of aluminium which are wound into compact coils, instead of preformed caps which are therefore bulky and fragile.

By using machines having a plurality of crimping heads which successively pass the closure station, it is possible to attain closure rates of more than 60,000 operations per hour. At such rates, it is more than ever necessary to avoid any stoppage. Now, production of caps involves a plurality of successive operations: cutting out a disc in a strip, stamping, and setting a seal in position. It has been found that it is not possible at the present time to design a compact production cell for supplying caps at sufficient rates, with full reliability.

It has been found that the solution to the problem set is to form the production unit of a plurality of production cells operating at more reasonable rates but the capacities of which are added together.

In addition, the cap production cells are machines comprising precise and delicate mechanical components. They cannot be installed in the immediate vicinity of the closure machine, stopping or starting of which can cause breakages among containers containing foaming substances or substances with an attacking action. Bottlers ask that, in the vicinity of the closure machine, space should be left free for the turntable or carrousel for the supply and discharge of the containers, to permit those machines to be cleaned, often with a powerful jet of water. It is therefore virtually impossible for a cap production cell and, a fortiori, two or more such cells, to be installed in the immediate vicinity of the closure machine.

Thus the solution of this complicated problem is to dispose in parallel a plurality of cap production cells, the number N of such cells being the number necessary to comply with the required closure rate C. More precisely, $N+1$ cells are disposed in parallel, each having a capacity of $C/N$ caps per hour. The additional cell in row $N+1$ is a reserve cell. In order to have a higher degree of flexibility and to avoid any break in the event of stoppage of an operational cell, the reserve cell is made the same. In normal operation, the $N+1$ cells operate permanently at a reduced rate, each providing $C/N+1$ caps per hour.

At any moment, a cell can stop, and the N cells which are in an active condition speed up their production to the theoretical rate of $C/N$ each.

The production of all the cells operating in a parallel mode is combined on a single conveyor which alone feeds the closure machine, while maintaining the orientation of the caps. In addition to its operation of bringing the caps together, the conveyor makes it possible to dispose the cells at a distance from the closure machine, or even enables the cells to be installed in an isolated chamber, protected from any liquid splashing.

In order to make the supply of caps to the closure machine even more certain and regular, the closure machine is supplied by gravity from an inclined passage or channel which is interposed between the machine and the conveyor. This channel, which is referred to hereinafter as the 'main channel', constitutes an intermediate storage means for caps which are retained in line. The capacity of the storage means is minimal but sufficient, however, to control operation of the conveyor and consequently the downstream cells, it makes it possible at any moment to adjust the rate of production of caps according to demand.

Likewise, the conveyor is supplied from each cell by gravity by way of an individual inclined channel which also forms a minimal intermediate storage means.

These inclined channels correspond in section to the caps, and thus retain the orientation thereof. They also have the advantage that, if there is a requirement for a compact installation with a horizontal conveyor, the conveyor is disposed at a position of being raised above the closure machine, and the cells above the conveyor. Thus, the conveyor and, a fortiori, the cells, are protected from any projection or splashing of liquid or pasty substances from the bottling station.

When a cell is stopped and the N remaining cells operate simultaneously, they are adjusted in practice so that each provides a number of caps which is a little greater than the required amount C/N, that is to say, $(C/N)+\epsilon$. They each feed their individual channel which, in the lower portion, is provided with a selector means for controlling the discharge of the caps to the conveyor. A certain number of caps are thus retained in the channel. They are blocked in the channel in a linear row without being able to ride up over each other, in a waiting condition such as to be able to supply the conveyor, one by one, simply by gravity.

Each individual passage or channel is provided with two detectors for defining two levels, an upper or 'maxi' level and a lower or 'mini' level. If each of the cells provides a number of caps $(C/N)+\epsilon$ which is more than the required number, the channel fills up. When the level of caps reaches the 'maxi' detector, that detector stops the cell or, which is better, causes it to operate at a reduced speed. The channel empties out. The level of the caps reaches the 'mini' level. The second detector in turn controls operation of the cell, to its nominal rate $(C/N)+\epsilon$.

When all the cells, namely $(N+1)$ are operational, the level of the caps in a waiting mode in each individual channel must also be capable in this case of oscillating between the levels of the mini and maxi detectors. In order to fill each channel up to the maxi level, the corresponding cell is operated at its maximum rate $(C/N)+\epsilon$. In order to empty the channel down to the mini level, the cell must operate at a speed which is lower than the required rate $(C/(N+1))$, that is to say, a rate of $(C/(N+1))-\epsilon'$.

Thus, each cell is regulated so as to operate at two rates, namely $(C/N)+\epsilon$ and $(C/(N+1))-\epsilon'$. Whether operation is with N or $N+1$ cells in a functional mode, production of the cells fulfills the demand, and the level in the individual channels varies constantly between the "mini" and "maxi" levels.

The conveyor is a cavity-type conveyor having a plurality of cavities, each of which is of dimensions corresponding to those of a cap, this being in order to preserve the orientation of the caps coming from the cells by way of the channels.

When all the cells, namely $N+1$, are in operation, the conveyor is fed by the $N+1$ individual channels which are disposed in succession along the path of the conveyor. All the cavities in the conveyor must be supplied with caps, without two caps being able to pass into the same cavity, with the danger of being wedged and deformed therein. This is the reason for providing the selectors which are disposed at the outlet of each individual channel. Each distributes the caps from its channel, one by one, into the successive cavities of the conveyor, by circular transposition. Each selector supplies the cavities in accordance with a step rate $(N+1)$, leaving the N intermediate cavities available to be supplied from N other individual channels.

Thus, when the $N+1$ cells operate simultaneously, all the cavities in the conveyor are supplied in turn from the $N+1$ channels following the $N+1$ cells. When a cell has stopped for any reason whatever, the corresponding channel would rapidly empty out if the outlet selector did not immediately stop distribution of caps into the cavities. The selector permanently maintains some caps in a condition of being loaded into the channel, and avoids transitory phenomena when the cell is returned to service. Consequently, one cavity is empty each time, following N full cavities. However, in all circumstances, the conveyor must supply the closure machine at the average rate of C caps per hour. For that purpose, the speed of the conveyor is varied in dependance on the level of the caps in the main channel, in the same way as the rate of each cell is varied in dependence on the level in its individual channel.

Like the individual channels, the main channel is provided with two detectors defining mini and maxi levels. Those detectors respectively produce a low speed and a high speed. The high speed is set for a cavity pass rate $C((N+1)/N)+\epsilon_1$, while the low speed is set for $C-\epsilon'_1$ with $\epsilon>(\epsilon_1/(N+1))$ and $\epsilon'>(\epsilon'_1/(N+1))$.

Thus, when all the $N+1$ cells are operating and all the cavities are loaded, the low speed of the conveyor, which is controlled by the upper detector, gives a cap flow rate of $C-\epsilon'_1$; which causes the level in the main channel to go down slowly. Conversely, when one of the $N+1$ cells is stopped and a cavity on each series of $N+1$ is not filled, the high speed of the conveyor $C((N+1)/N)+\epsilon_1$ permits the level of caps to rise again when the mini level is reached in the main channel at a downstream position.

Finally, all the inclined channels, both the main channel and the individual channels, are provided with two additional detectors. A high detector above the maxi detector and a low detector below the mini detector. For the main channel, the high detector detects an anomaly downstream and stops the conveyor. The low detector detects an anomaly upstream. It sets an alarm in operation, and stops the closure machine.

For each individual channel, the high detector stops the corresponding cell, the low detector sets the cell in operation again if it is stopped, or stops it, while signalling an anomaly, if it is operating.

It will be seen that, in the event of an incident either at an upstream position or at a downstream position, the whole of the installation stops in a cascade mode, without any necessity to provide any other control action.

In practice, in view of the complexity of the installation and the inertia of the equipment and the containers to be set in motion, the integrated packaging chains are not set abruptly in operation at their maximum capacity, but are set in operation progressively or, more frequently, in stages. Thus, the nominal closure rate varies progressively from a minimum $C_m$ to a maximum $C_M$. The motors of the various machines, including those of the cells of the conveyor, are actuated by variable-speed motors. The whole of the installation operates in accordance with a program which is dependent on the nominal instantaneous rate $C_1$.

The invention will be better appreciated from the following description of an actual embodiment given by way of example and illustrated in the accompanying drawings.

Figure 2:
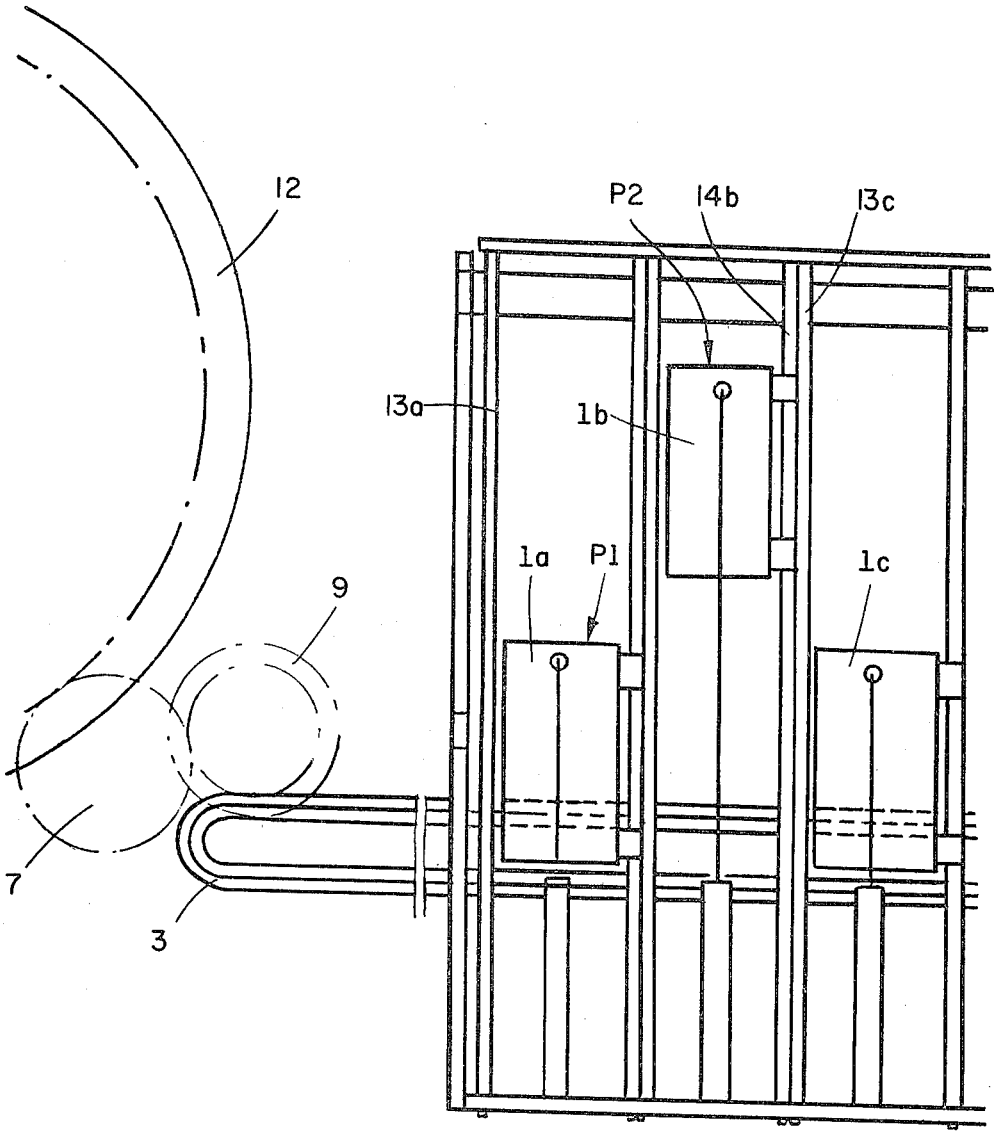
Figure 3:
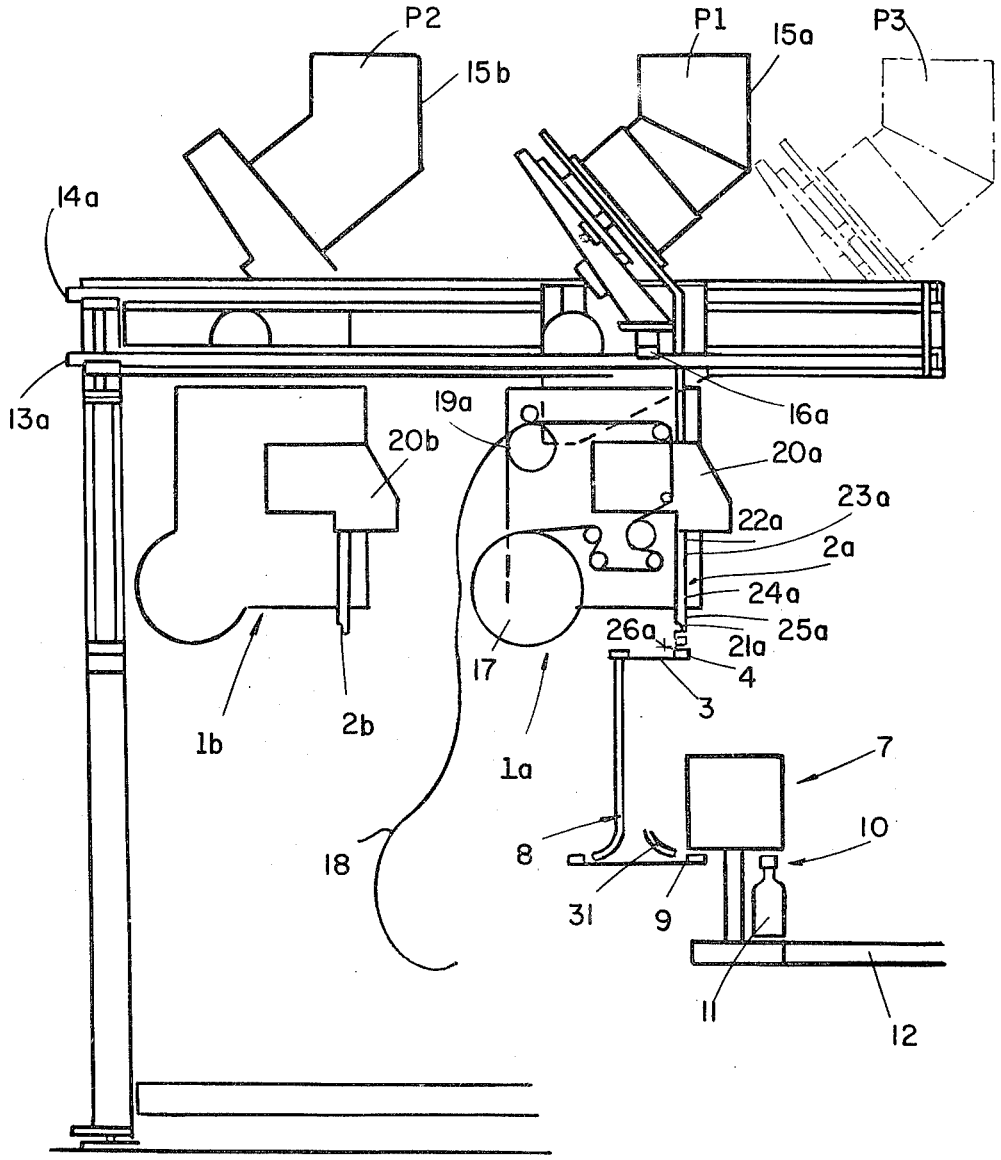
Figure 4:
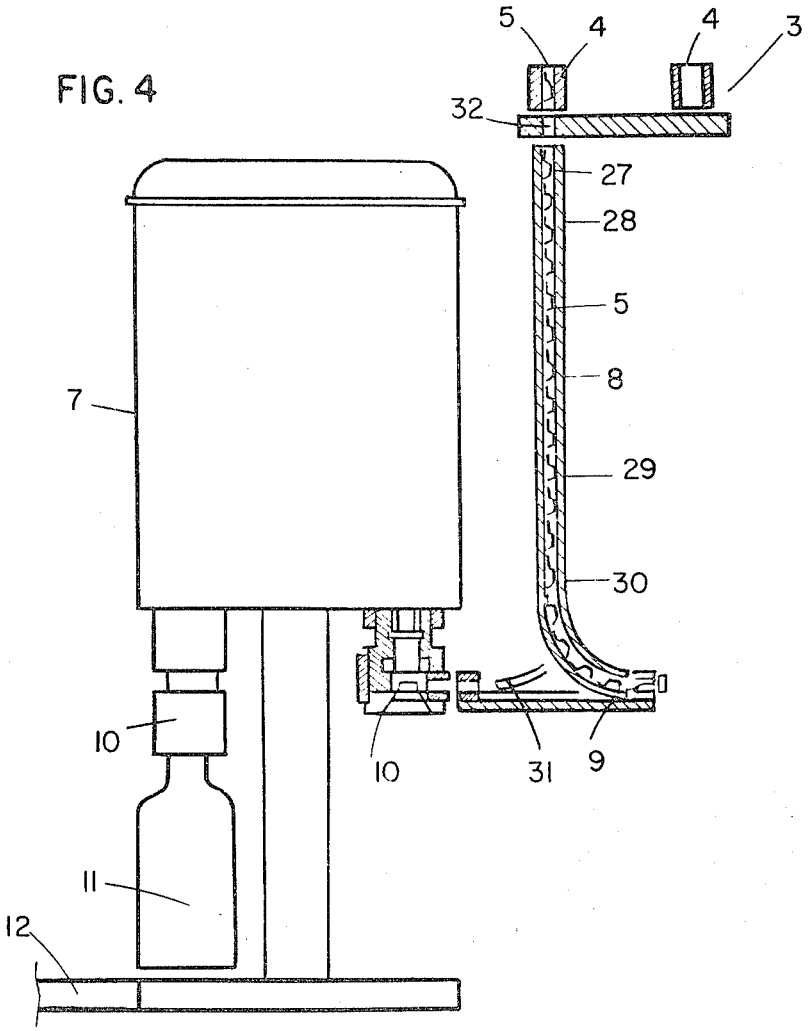
Figure 5:
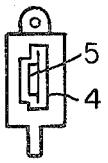

FIG. 1 shows a perspective view of a cap production installation, a conveyor and a closure machine, FIG. 2 is a diagrammatic plan view of the installation of FIG. 1, FIG. 3 is a diagrammatic elevational view of the installation of FIG. 1, FIG. 4 is a view in vertical section of the conveyor and the connection thereof by way of an inclined passage or channel to the closure machine, and FIG. 5 shows a plan view of one of the carriages of the conveyor.

The installation illustrated corresponds to the situation in which the number (N+1) of cells installed is 5. The illustrated installation can operate with only 4 cells in operation. Each element of the installation is defined by a reference numeral and identical elements such as the five cells are distinguished by alphabetic indices.

FIG. 1 shows five cells 1*a*, 1*b*, 1*c*, 1*d*, 1*e* for producing caps, which are illustrated diagrammatically in FIG. 1 by simple parallelepipeds. The five cells 1*a* to 1*e* can supply a single conveyor 3 by viture of gravity, by way of five individual inclined passages or channels 2*a*, 2*b*, 2*c*, 2*d* and 2*e*. The single conveyor 3 brings together the production of the five cells.

In FIGS. 1, 2 and 3, the cells 1*a*, 1*c*, 1*d* and 1*e* are in the operational position $P_1$, while the cell 1*b* is in a retracted position, in a position $P_2$ for maintenance.

FIG. 3 shows in broken lines a forwardly displaced position $P_3$ for reloading.

The conveyor is formed by an endless chain of carriages, each comprising a bottomless vertical cylindrical cavity 4 which is open at the upper and lower parts thereof. The horizontal section of the cavities, which are of plastics material, closely corresponds to the cross section of a cap 5, as shown in FIG. 5, so that the caps which have tongue portions, being introduced vertically, are constrained to remain in the orientation that they had in the individual channels 2*a* to 2*e*. The conveyor 3 shown in FIGS. 1, 2 or 3 is straight and horizontal. It rests on a table 6, on which the caps 5 slide, being entrained in their vertical cavities 4. However, the conveyor 3 may equally well include curves, or rising or falling portions, imparting maximum flexibility to the installation. Instead of resting on a table 6, it can also be accompanied by a simple lower slide means which supports the caps in the cavities.

The conveyor 3 feeds the closure machine by way of an inclined main channel 8 and a distributor disc 9, as will be described in greater detail hereinafter. The closure machine 7 comprises a plurality of crimping heads 10 which make it possible to close the bottles 11 supplied by a turntable or carrousel 12, at a rate of 60,000 operations per hour.

The five cells 1*a* to 1*e* are each suspended on two slide members 13*a*, 14*a*; 13*b*, 14*b*; 13*c*, 14*c*; 13*d*, 14*d*; 13*e*, 14*e* disposed in the upper part of a frame structure defining the volume of the cap production unit, and displaced in respect of height relative to each other. The slide members permit the five cells 1*a* to 1*e* to be moved easily transversely forwardly or rearwardly with respect to the conveyor 3 for reloading with raw material (aluminum strip or plastics seal) or for maintenance. The three positions $P_1$, $P_2$ and $P_3$ are shown in FIG. 3. Suspending the cells from slide members in an elevated position provides particularly easy access thereto, while protecting them from most of the liquid splashes that may occur.

As shown in FIG. 3, each cell is associated with a hopper 15*a*, 15*b*, 15*c*, 15*d* and 15*e* and a mechanism for supplying seal members, designed in accordance with a known art. The cells are in fact mounted on the slide members by way of shoes or skids 16. They can thus be easily raised by a lifting carriage or pulley block assembly, and very easily replaced. Movement of each cell into the three positions $P_1$, $P_2$ and $P_3$ is controlled by a jack that can be easily disconnected.

FIG. 3 shows a strip 17 of aluminium which is wound in the form of a coil. The skeleton 18 of the strip, after discs corresponding to the sizes of the caps 5 have been cut out, is entrained by a wheel 19, for recovery thereof. The caps which have been cut out, shaped and provided with their seal by the mechanisms 20*a*, 20*b*, 20*c*, 20*d* and 20*e* of each cell are immediately distributed into the corresponding individual channel 2*a* to 2*e*. They are in a vertical position with their tongue portions rearwardly, that is to say, in this case, upwardly, as shown in FIG. 4, in respect of the main channel 8.

Each individual channel 2*a* to 2*e* is divided into two rigid elements, an upper element which is fixed with respect to the corresponding cell and a lower element which is fixed with respect to the table of the conveyor 3. The two elements of each channel are connected together by a latching device 21*a*, 21*b*, 21*c*, 21*d* and 21*e* which, when it is in an operational condition, precisely fixes the position of each cell with respect to the conveyor 3. Only the latch device 21*a* of the channel 2*a* is shown in FIG. 3, but the same device is used on the five individual channels.

Each individual channel 2*a*, 2*b*, 2*c*, 2*d* and 2*e* is provided with four detectors respectively, as indicated at 22*a*, 23*a*, 24*a*, and 25*a*, 22*b*, 23*b*, 24*b* and 25*b*, 22*c*, 23*c*, 24*c* and 25*c*, 22*d*, 23*d*, 24*d* and 25*d*, 22*e*, 23*e*, 24*e* and 25*e*, which are distributed in succession over the length thereof, and a distribution selector 26*a*, 26*b*, 26*c*, 26*d* and 26*e* at its end, that is to say, at its connection to the conveyor 3, as shown diagrammatically in FIG. 3. The selectors are in the form of a star wheel, the arms of which are spaced by the diameter of a cap. They control the discharge of the caps synchronously with the passing movment of the cavities 4 of the conveyor. The cavities 4 are filled by circular transposition, the selectors associating each of the successive cavities with one of the five channels 2*a* to 2*e*. If a selector stops, one cavity in five will not be filled.

The main channel 8 is also provided with four detectors 27, 28, 29 and 30. It opens within the rim, which is divided into compartments, or a distributor disc 9, as shown in FIG. 4. The disc rotates about an axis which is parallel to that of the closure machine 7. It rotates at a circumferential speed which is substantially half the speed of the heads 10. The compartments in the disc are so disposed as each to come to a position opposite a head 10 when the installation is in operation and the disc, like the heads, are rotating at high speed. In this way, the caps 5 first pass by gravity from the channel 8 into the compartments where they are retained by a peripheral restraint ring or band. They are then thrown one by one by centrifugal force through an aparture from the compartments into each of the heads 10. If necessary, a compressed air nozzle 31 facilitates the transfer of the caps 5 from the compartments into the heads 10. The relatively low speed of rotation of the disc 9 permits the compartmenta to be loaded without difficulty from the stationary channel 8. The same speed of rotation of the disc 9 then permits the heads 10 to be loaded, without an excessive variation in speed. The disc 9 moreover prevents wastage of caps 5. When a cap 5 which has not been used remains in a head 10 from a previous transfer movement, it repulses that cap which is presented in a compartment of the disc 9, and that cap in turn repulses the cap which will be presented at the bottom of the channel 8.

Each of the channels 2a, 2b, 2c, 2d and 2e, and 8, is of a cross section closely corresponding to that of the caps 5. The same applies in regard to the cross section of the cavities 4 in the conveyor, and the compartments of the disc 9. Thus, the orientation which is initially imparted to the caps on issuing from the cells 1a to 1e is maintained into the heads 10.

In normal operation, a small amount of caps 5 is stopped in line in each of the respective channels 2a to 2e and 8, as shown in FIG. 4.

If the arrangement uses caps having two tongue portions in a V-shaped configuration, in accordance with French patent specification No. 2 445 295, the skirt portion of each cap 5 engages between the two V-shaped tongue portions of the preceding cap, and the caps can neither ride up over each other nor jam each other, as disclosed in French patent specification No. 2 445 295. (U.S. Pat. No. 4,231,479).

Each channel thus forms a small intermediate storage means providing a load for the device downstream thereof, that is to say, the conveyor 3 in regard to the individual channels 2a to 2e or the distributor disc 9 in regard to the main channel 8.

In the event of a stoppage, some caps are retained in the channels by the selectors or the disc, which avoids any difficulty upon restarting the installation. The vertical channels provide for a sound and regular supply of caps to the closure machine, with a very simple control system, while maintaining the caps in the orientation that they had on issuing from the production cells.

In the main channel 8, if the level of caps 5 falls below the lower detector 30 of that channel, there is a deficiency in the supply of caps. The detector 30 immediately stops the closure machine and the turntable 12 for providing the supply of bottles 11.

If the level of the caps 5 rises above the upper detector 27, there is a cap over flow due to a mishap in the closure machine 7 or in the supply of bottles 11. The dector 27 immediately stops the conveyor 3 and consequently the cells 1a to 1e downstream.

Between these two limit levels 27 and 30, the detectors 28 and 29 define the 'maxi' and 'mini' levels in the channel 8. The presence of a cap at the maxi level 28 causes the conveyor 3 to be slowed down to its low speed. The absence of cap at the mini level 29 causes the conveyor 3 to be accelerated to its high speed.

In this case, the closure operating rate C of the machine 7 is 60,000 bottles per hour. The high speed of the conveyor 3 corresponds to a maximum cavity rate of $C((N+1)/N)+\epsilon_1$; that is to say, 75,500 cavities 4 per hour, while its low speed $C-\epsilon'_1$ corresponds to 59,500 cavities 4 per hour.

Thus, when four production cells only are in operation and only four cavities 4 out of five of the conveyor 3 are filled, the conveyor 3 supplies the main channel at rates of 4/5 of 59,500 or 4/5 of 75,500 caps per hour, that is to say, 47,600 or 60,400 caps per hour respectively, depending on whether it is operating at low speed or at high speed. With the consumption of caps being 60,000 caps per hour, the level in the main channel can vary between the mini level and the maxi level 29 and 30.

On the other hand, when the five cells 1a to 1e are in operation and all the cavities 4 of the conveyor 3 are being filled, the conveyor supplies the main channel 8 at a rate of 59,500 or 75,500 caps per hour. The level of caps in the main channel can once again oscillate between the mini level 29 and the maxi level 28.

In a parallel manner, the two rates of production of each of the cells 1a to 1e, that is to say $(C/N)+\epsilon$ and $(C/(N+1))-\epsilon'$ are 15,200 and 11,800 in this case. When five cells 4 are operating, production varies between 76,000 and 59,000 caps per hour. In both cases, the production capacities embrace the capability of the conveyor 3 for taking the caps, at the bottom of the individual channels. The level of caps in each of the individual channels 2a to 2e varies between the mini level 24a, 24b, 24c, 24d and 24e and the maxi level 23a, 23b, 23c, 23d and 23e, always with some caps in a waiting condition between the selector 26a, 26b, 26c, 26d and 26e and the corresponding mini level 25a, 25b, 25c, 25d and 25e.

Finally, it is known that, in regard to bottling installations operating at rates starting from 20,000 and, a fortiori, 60,000, the installations are not set in operation or stopped abruptly but progressively or at least in stages. Thus, for a nominal rate C of 60,000, the installation has intermediate rates $C_1$, $C_2$, $C_3$, $C_4$ of 5,000, 10,000, 20,000 and 40,000.

The motors of the entire cap production installation are variable speed motors. The speed of the motors varies in dependence on the nominal rate C. The small reserve of caps in the main channel 8 between the distributor disc 9 and the lower detector 30 which causes general stoppage of the installation, and the few caps which are stored in the disc 9 and the heads 10, are very useful by virtue of making it possible for stoppage of the installation to be absorbed or dampened a little. The small reserve of caps between each of the individual selectors 26a, 26b, 26c, 26d and 26e and the lower detector 25a, 25b, 25c, 25d and 25e of each individual channel 2a, 2b, 2c, 2d and 2e is also greatly appreciated by the person responsible for operating the bottling installation.

As regards the conveyor 3, it should be noted that the carriages thereof are joined together by universally jointed hook arrangements which permit the conveyor to follow variations in its line of movement, and which make it possible for the mechanical part where the five calls 1a to 1e are grouped together to be disposed at a distance from the bottling and bottle-capping region.

As shown in FIGS. 4 and 5, the cavities 4 in the carriages of the conveyor are vertical bottomless cavities. They are closed at the lower part thereof only by the table 6 of the conveyor 3. Therefore, they readily receive the caps 5 from the individual channels 2a to 2e, simply due to the force of gravity. It is sufficient to provide an opening 32 of suitable section above the channel 8 for the full cavities 4 to discharge their caps into the channel 8 under the force of gravity.

It will be seen that this installation, while appearing to be complicated, is very flexible and highly reliable in operation, by virtue of its original control arrangements and lay-out.

I claim:

1. An installation for the supply without interruption of fragile caps, which are in a given orientation, to crimping heads of a closure machine which operates at a high rate, said installation comprising in a parallel arrangement a plurality of cap production cells and, as means for supplying caps to the machine from the cells, a cavity-type conveyor in the form of an endless chain having vertical bottomless cavities, means for feeding caps to the cavities from each cell including an inclined individual channel, each individual channel having an outlet provided with a selector controlling the supply of caps to the successive cavities of the conveyor by circular transposition, and means for supplying the machine from the conveyor including a main inclined channel which opens on to a distributor disc having compartments movable into positions opposite the heads.

2. An installation according to claim 1 wherein the cross section of each of the inclined channels (main and individual) and the cross section of the conveyor and the compartments of the distributor disc substantially correspond to the cross section of the caps.

3. An installation according to claim 1 wherein the production cells are disposed above the conveyor and are each suspended on horizontal slide members in a plane perpendicular to the conveyor, said slide members permitting each cell to be displaced independently and laterally with respect to the conveyor without interfering with operation of the remainder of the installation.

4. An installation according to claim 1, 2 or 3 wherein each channel providing for the transfer of caps from a cell to the conveyor comprises two elements, one being fixed with respect to the conveyor and the other being fixed with respect to the cell, the two elements being connected together by latching means and thus defining a given position for each cell when in operation.

5. An installation according to claim 1 or 2 wherein the production cells are suspended from transverse slide members disposed at an elevated position and easily displaced into three positions: operational, reloading and maintenance.

6. An installation according to claim 5 wherein the cells are mounted on slide members by way of slide shoes.

7. An installation according to claims 1, 2 or 3 wherein the production cells are operable at two speeds $(C/N)+\epsilon$ and $(C/(N+1))-\epsilon'$, mini and maxi level detectors associated with the corresponding individual channels for control of the operable speed of the production cells in response to the levels within the individual channels, the conveyor being operable at two cavity movement rates $C((N+1)/N)+\epsilon_1$ and $C-\epsilon'_1$, mini and maxi level detectors associated with the main channel, said rates being controlled respectively by the mini and maxi detectors of the main channel.

8. An installation according to claim 7 wherein the circumferential speed of the distributor disc is substantially half the circumferential speed of the crimping heads.

9. An installation according to claim 1 wherein the circumferential speed of the distributor disc is substantially half the circumferential speed of the crimping heads.

10. A process for continuously supplying fragile caps, in a given orientation, to a closure machine operating at a high rate (C), from at least N+1 cells for producing said caps, N being the minimum number of cells necessary to comply with the nominal closure rate C, the caps being collected at the outlet of the cells and transferred towards the closure machine by an endless chain conveyor with successive cavities, comprising the steps of transferring the caps between each cell and the conveyor by an individual channel, detecting mini and maxi levels in each individual channel, each cell being operable at two rates, a normal rate $(C/N)+\epsilon$ and a lower rate $(C/(N+1))-\epsilon'$, varying the rate of each cell in accordance to the levels detected in the corresponding channel, each individual channel being provided with an outlet selector, and feeding the caps from the outlet selectors into the successive cavities of the conveyor, each cavity thus being associated with one of the successive individual channels, transferring the caps between the conveyor and the machine by a main channel, detecting mini and maxi levels in the main channel, the conveyor being a two-speed cavity-type conveyor, the maximum rate of which is at a minimum equal to the rate of production of the N+1 cells and can be reduced to a lower rate corresponding at maximum to the nominal closure rate C, and causing the conveyor to go from one speed to the other speed in accordance with the levels detected in the main channel.

11. A process according to claim 10 further including transferring the caps from the outlet of the main channel to the crimping heads on the machine by a distributor disc rotating at a circumferential speed that is half the speed of the heads.

12. A process according to claim 10 or claim 11 including providing each main and individual channel with go-stop detectors respectively below and above the mini and maxi levels.

* * * * *